US006874174B2

(12) United States Patent
Worthington

(10) Patent No.: US 6,874,174 B2
(45) Date of Patent: Apr. 5, 2005

(54) POOL INSULATION SYSTEM

(75) Inventor: Timothy Kevin Worthington, Malaga (ES)

(73) Assignee: Hotballs (UK) Limited, Surrey (GB)

( * ) Notice: Subject to any disclaimer, the term of this patent is extended or adjusted under 35 U.S.C. 154(b) by 0 days.

(21) Appl. No.: 10/250,979

(22) PCT Filed: Jan. 11, 2002

(86) PCT No.: PCT/GB02/00105

§ 371 (c)(1),
(2), (4) Date: Jul. 10, 2003

(87) PCT Pub. No.: WO02/059438

PCT Pub. Date: Aug. 1, 2002

(65) Prior Publication Data

US 2004/0019963 A1 Feb. 5, 2004

(30) Foreign Application Priority Data

Jan. 24, 2001 (GB) ..... 0101843

(51) Int. Cl.[7] ..... E04H 4/00
(52) U.S. Cl. ..... 4/498; 4/488; 4/493
(58) Field of Search ..... 4/498, 500, 488, 4/493; 441/1, 133; 114/242, 253, 254

(56) References Cited

U.S. PATENT DOCUMENTS 3,604,532 A * 9/1971 Moore ..... 114/362
3,998,204 A * 12/1976 Fuchs et al. ..... 4/498
4,137,612 A 2/1979 Kelley
5,085,767 A 2/1992 Beers
5,114,272 A 5/1992 Brunhoff et al.
5,538,359 A * 7/1996 Wadle et al. ..... 405/70
5,853,309 A 12/1998 Biggs

FOREIGN PATENT DOCUMENTS

DE 3437124 A1 * 4/1986
GB 1490069 10/1977
WO WO 97/00365 1/1997

* cited by examiner

*Primary Examiner*—Gregory L. Huson
*Assistant Examiner*—Khoa D. Huynh
(74) *Attorney, Agent, or Firm*—Stephen Eland; Dann, Dorfman, Herrell and Skillman

(57) ABSTRACT

A pool insulation system including storage means 2 for storing a plurality of buoyant articles 50, first transfer means 30 for transferring the buoyant articles from the storage means 2 to a pool 1 and second transfer means 3,4 for transferring the buoyant articles from the pool to the storage means 2. The second storage means comprises a flexible boom 3 and a motorised craft 4 manoeuvrable around the pool with the boom attached thereto so that the buoyant articles 50 on the surface of the pool are contained in an enclosure defined by the flexible boom. Means are provided to change the length of the flexible boom on the surface of the pool 1. The invention also relates to a method of removing buoyant articles from the surface of a pool 1, an automatic boom deployment system for a pool, pool apparatus and a pool docking system.

24 Claims, 6 Drawing Sheets

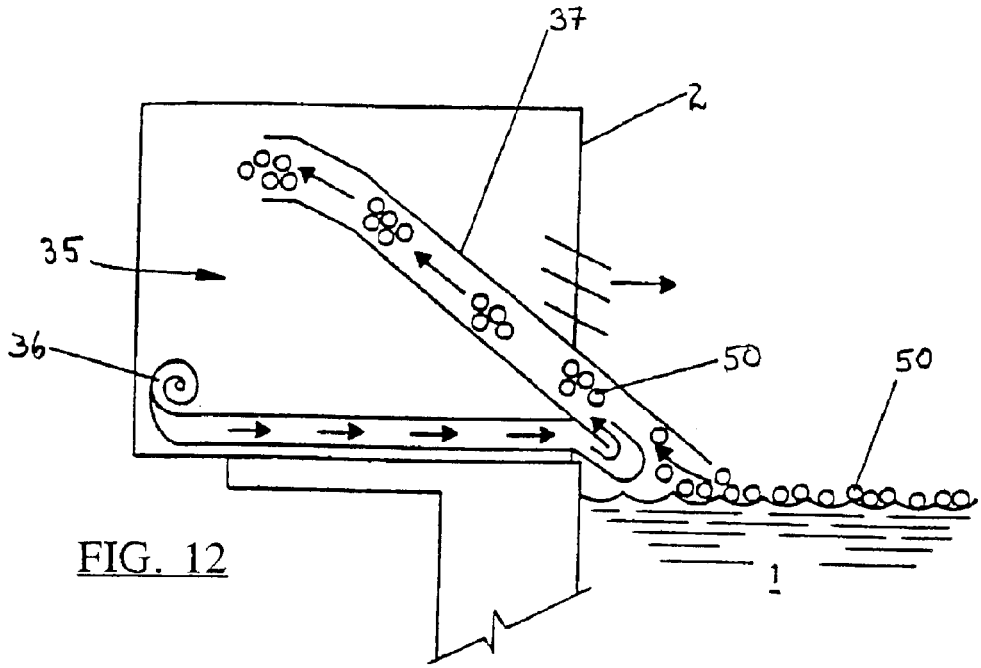
FIG. 12
FIG. 13
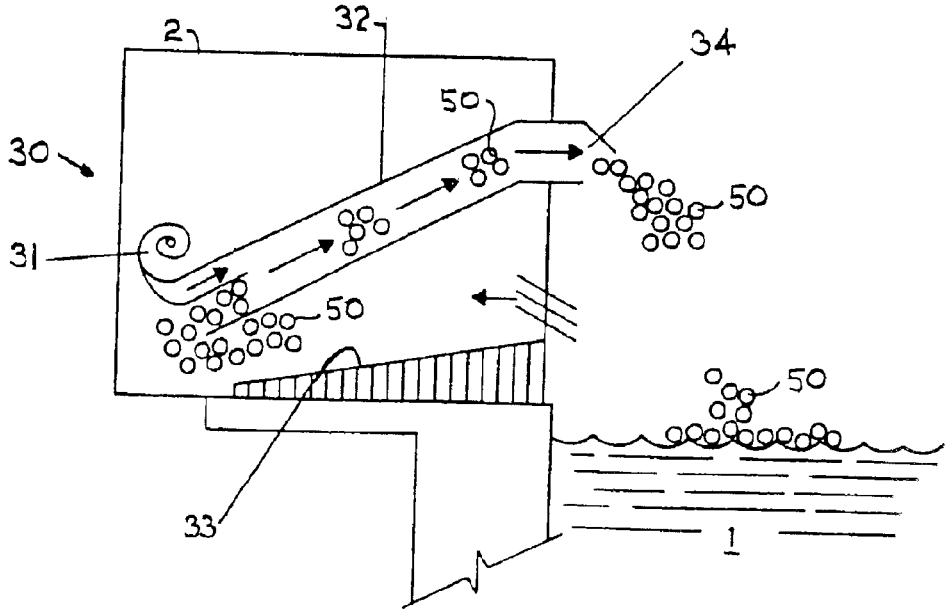

POOL INSULATION SYSTEM

PRIORITY APPLICATIONS

This application is a 371 application of International Application No. PCT/GB02/00105 filed Jan. 11, 2002, which claims priority to United Kingdom Patent Application No. 0101843.1 filed Jan. 24, 2001. Each of the foregoing applications is hereby incorporated herein by reference.

This invention relates to a pool insulation system of the kind including storage means for storing a plurality of buoyant articles, first means for transferring said buoyant articles from the storage means to the pool for covering and heat insulating the surface of the pool and second transfer means for transferring the buoyant articles from the pool to the storage means. The invention also relates to a method of, and apparatus for, removing a plurality of buoyant articles from the surface of a pool.

A known pool insulation system of the kind referred to is described in WO-A-97/00365. In this known system a plurality of buoyant balls are discharged from the storage means, in the form of a container at the side of the pool, so as to cover the surface of the pool. The balls are transferred back from the pool to the storage means by a suction device which sucks the balls from the surface of the pool and transports them back into the storage means. The problem with this known pool insulation system is that it is difficult to remove the buoyant balls rapidly and efficiently from the surface of the pool. In particular, some of the balls tend to become stuck in the corners of the pool or behind obstructions, such as steps or ladders, in the pool. Furthermore it is difficult to create sufficient suction to be able to suck the balls situated furthest from the suction device.

Another known pool insulation system of the kind referred to is described in GB-A-1490069. This known system describes the use of a rigid boom supported at its opposite ends on guide rails extending along opposite sides of a rectangular pool. The storage means is positioned at one end of the pool and the boom is normally positioned at the other end of the pool. In use, in order to remove the buoyant articles from the surface of the pool, the boom is moved towards the one end of the pool. The buoyant articles are pushed by the boom over a weir at the one end of the pool into the storage means. One disadvantage of this known system is that it can only be applied to removing buoyant articles from the surface of a rectangular pool.

It is an aim of the present invention to provide a pool insulation system of the kind referred to which overcomes the disadvantages of the prior art systems.

According to one aspect of the present invention a pool insulation system including storage means for storing a plurality of buoyant articles, first transfer means for transferring said buoyant articles from the storage means to the pool for covering and heat insulating the surface of the pool and second transfer means for transferring the buoyant articles from the pool to the storage means, is characterised in that the second transfer means comprises a buoyant flexible boom having a leading end, a motorised craft manoeuvrable around the periphery of the pool with the leading end of the boom attached thereto for containing any buoyant articles on the surface of the pool in an enclosure defined by the trailing flexible boom on the surface of the pool and a wall portion of the pool from or adjacent which the articles are to be removed from the pool, and means for changing the length of the flexible boom on the surface of the pool.

Preferably said second transfer means includes powered removal means for causing the buoyant articles to be moved upwardly from said enclosure to said storage means. Conveniently the powered removal means includes suction or blower means. Alternatively, however, the powered removal means may comprise, for example, an endless conveyor device or an Archimedes screw-type device.

Conveniently the second transfer means further comprises containing means for containing the flexible boom and said length changing means comprises feed means for selectively feeding the flexible boom into the pool from the containing means or into the containing means from the pool.

The craft is provided with propulsion means, e.g. one or more propellers, for providing forward thrust. The craft is preferably designed so as to steer to one side in use so that it is able to hug the peripheral walls of the pool. The craft can be designed to veer in one direction by the use of one or more of the following measures: directing the propulsion means so that the craft veers right or left; attaching the leading end of the flexible boom to a rear portion of the craft offset from the longitudinal axis of the craft (i.e. offset to the "wall-hugging" side of the craft); angling the bow of the craft so as to provide a sideways thrust on forward movement of the craft through the water; and providing one or more separate side-thrusting propellers. If side thrusting propellers are provided, the craft may include wall sensing means for determining when the side-thrusting propellers need to be operated to move the craft towards the peripheral wall.

The craft is preferably provided with one or more friction wheels mounted at the front of the craft and positioned to contact, in use, obstructions or walls extending from a wall along which the craft is being propelled, the or each friction wheel being rotatable about a vertical axis in a direction to cause the front of the craft to move away from the wall along which the craft is being propelled.

Preferably the pool insulation system includes attachment means for automatically mooring the craft to the said wall portion after circumnavigation of the pool. Suitably said attachment means comprises a first attachment member mounted at said wall portion and a second attachment member on said craft, one of said attachment members (preferably the first attachment member) comprising ferromagnetic material and the other of said attachment members comprising magnetic means. In this case the first attachment member may conveniently comprise a cylinder mounted for rotation about a vertical axis. Sensing means may be provided to detect when the craft is attached to the first attachment member to cut drive power to the craft.

According to another aspect of the present invention there is provided a method of removing buoyant articles from a surface of a pool, comprising positioning a flexible boom on the surface of the pool so as to form an enclosure around the buoyant articles to be removed, the enclosure being formed by the length of the flexible boom supported on the surface of the water and a wall portion of the pool from or adjacent which the buoyant articles are to be removed, withdrawing the buoyant articles from a portion of said pool at or adjacent the said wall portion, and reducing the peripheral length of said enclosure as the buoyant articles are removed from the pool by reducing the length of the flexible boom supported on the surface of the pool. Additional powered removal means may be provided for transferring the buoyant articles from within the enclosure to storage means.

Embodiments of the invention will now be described, by way of example only, with particular reference to the accompanying drawings, in which:

FIGS. 12 and 13 are schematic side views of means for transferring buoyant articles from the pool to the storage means and from the storage means to the pool, respectively.

A pool insulation system in accordance with the present invention is generally described below with particular reference to FIG. 1 which 1 is a schematic plan of a swimming pool 1 (outdoor or indoor) having storage means, generally designated 2, at one end of the pool for storing a plurality of buoyant balls 50 (see FIG. 3). Although not shown in FIG. 1, each of these balls is typically hollow, moulded from plastics material and has a flattened spherical shape, i.e. typically circular in cross-section in one plane and elliptical in cross-section in another perpendicular plane. By way of example, the circular cross-section may be of about 39 mm diameter, the minor axis of the elliptical cross-section may be about 22 mm (the major axis being the same as the circular diameter of 39 mm) and the wall thickness of the buoyant ball may be about 0.7 mm.

Figure 1:
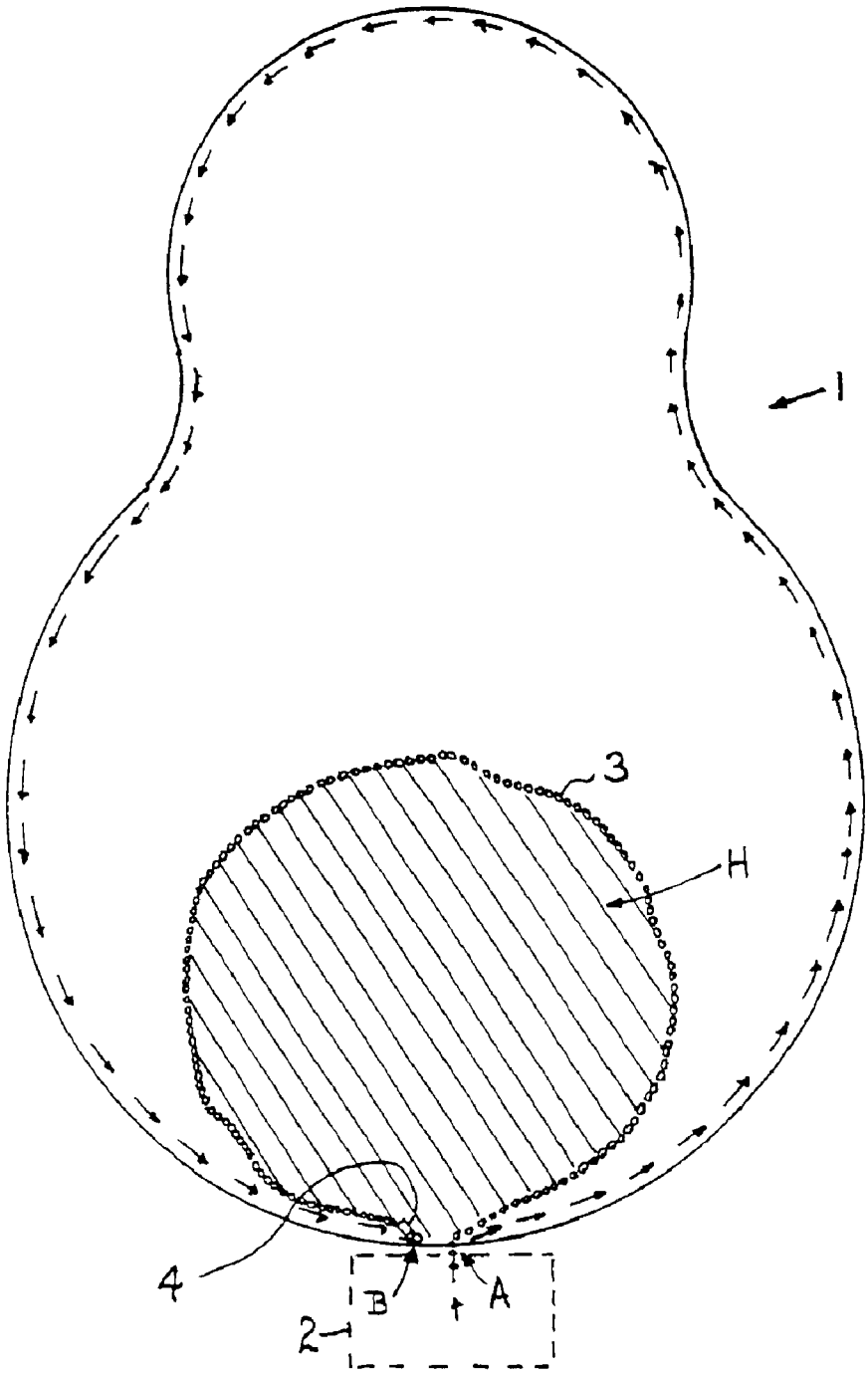
FIG. 1 is a schematic plan of a pool insulation system according to the invention and including a flexible boom floating on the surface of the water of a pool.

Although not shown in FIG. 1, ball moving means are provided for delivering the buoyant balls from the storage means 2 onto the surface of the pool 1. If the storage means is positioned with the lowermost part of its storage volume positioned above the water surface of the pool, the balls 50 may be delivered onto the surface of the pool by opening a lower outlet and allowing the balls to fall under gravity onto the pool surface. Typically, however, some form of powered transfer device is required for transferring the balls from the storage means to the pool surface. FIG. 13 illustrates one known design of transfer means 30 for transferring buoyant balls from the ball storage means 2 to the surface of the pool 1. The transfer means 30 includes an air blower 31 which blows air up an open-ended inclined tube 32. The bottom 33 of the storage means is inclined so that the balls 50 roll towards the bottom inlet end of the tube which is suitably located near the lowermost region of the storage means. The upper end 34 of the tube 32 exits from an upper part of the storage means 2 so that balls blown up the tube by air from the blower 31 are able to fall under gravity onto the surface of the pool. This known transfer means is fully described in WO 97/00365 and will not be described in further detail herein.

A sufficient number of buoyant balls 50 must be provided to cover the entire surface of the pool 1 and the storage means will need to be sized to enable the total number of balls to be housed. The precise number of balls required will, of course, depend on the size of each ball and the surface area of the pool 1.

In order to assist in the removal of the buoyant balls from the surface of the pool 1, there is provided a buoyant flexible boom 3 having a front end to which a motorised craft 4 is fixed. The craft 4 is able to manoeuvre automatically around the periphery of the pool pulling the flexible boom behind it. Initially the boom 3 is stored out of the water. The craft 4, which preferably is also stored out of the water, enters the pool 1 at position A and travels around the periphery of the pool, following the arrowed path in FIG. 1, until it reaches position B where it docks against the wall of the pool. As the craft 4 travels around the periphery of the pool, the flexible boom 3 is fed out from its storage position by variable speed boom drive means 12 (see FIG. 6) and follows the path of the craft 4. In this manner all the buoyant balls are initially surrounded and enclosed by the flexible boom 3.

When the craft reaches its docking position B, further ball moving means are operated to transfer the balls back from the pool surface into the storage means 2. A known design of transfer means 35 is shown in FIG. 12 and includes an air blower 36 for directing air up an inclined open-ended tube 37. The lower of the tube is positioned adjacent the surface of the pool 1 and the upper end of the tube 37 delivers the buoyant balls sucked up the tube into an upper part of the storage means 2. The transfer means 35 is fully described in WO 97/00365 and will not be described in more detail herein. At the same time, or shortly after commencement of this ball transfer from the pool to the storage means 2, the boom drive means 12 is operated to draw the rear end of the flexible boom 3 back into the storage position thus reducing the area of the water surface encircled by the boom. In FIG. 1 the flexible boom 3 is shown in a position in which it has been partially withdrawn into its storage position. The cross-hatched part H indicates the area encircled by the boom 3 and within which the balls still to be transferred back into the storage means 2 are retained.

Features of the pool insulation system will now b described in more detail below.

Figure 2:
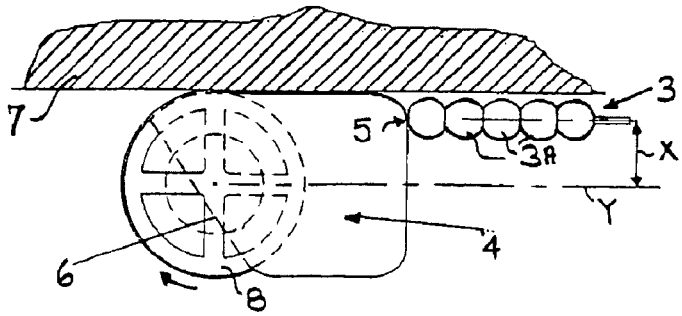
FIGS. 2 and 3 are a plan and side view, respectively, showing one embodiment of a boom positioning craft of the pool insulation system of FIG. 1.
Figure 3:
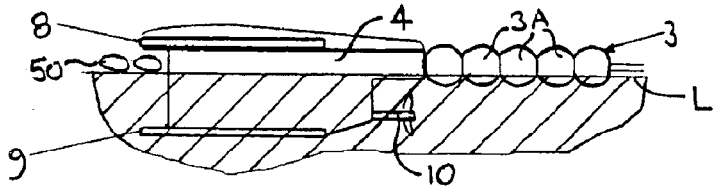

FIGS. 2 and 3 illustrate one embodiment of an automatically steerable craft 4. The purpose of the craft 4 is to deploy the flexible boom 3 by navigating the periphery of the pool 1. As can be seen in the drawings, the boom 3 consists of a plurality of joined together buoyant members 3A which are movable, at least to a limited extent, relative to each other. The craft 4 must be able to negotiate various obstacles, such as steps, ladders corners and curvatures. With the craft 4 illustrated in FIGS. 2 and 3, these aims are achieved through a combination of features. In particular the craft 4 has a boom attachment point 5 offset by an amount X from the longitudinal axis Y of the craft and an angled or wedge shaped bow 6 which cause the craft to steer towards wall 7 of the pool. Negotiation of obstacles is achieved by using upper and lower rotating friction wheels 8 and 9, the upper wheel 8 being situated above the water level L of the pool 1 and the lower wheel 9 being situated below the water level L. The wheels rotate in such a direction (the clockwise direction as viewed in FIG. 2) that, if they hit an obstruction, the bow of the craft is urged outwardly away from the wall 7 and the offending obstruction. The craft 4 is driven forwards by one or more propellers 10.

Figure 4:
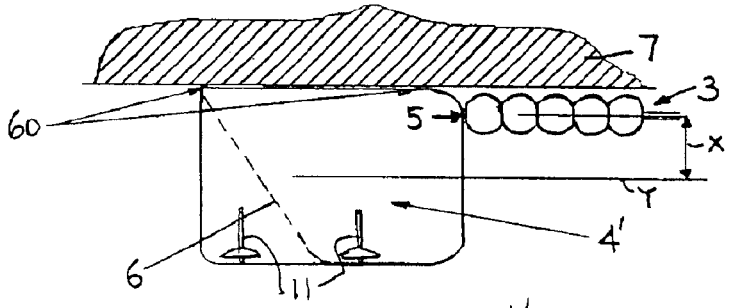
FIGS. 4 and 5 are a plan and side view, respectively, showing another embodiment of a boom positioning craft of the pool insulation system according to the invention.
Figure 5:
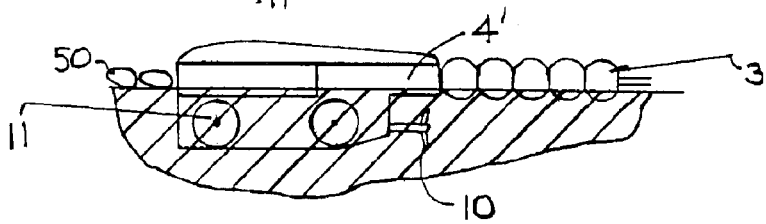

An alternative design of craft 4' is illustrated in FIGS. 4 and 5. Where possible similar parts of the crafts 4 and 4' have been identified by the same reference numerals. The craft 4' is not provided with wheels 8, 9 but instead has side thrusters 11, e.g. propellers, which are used in combination with sensors 60.

Figure 6:
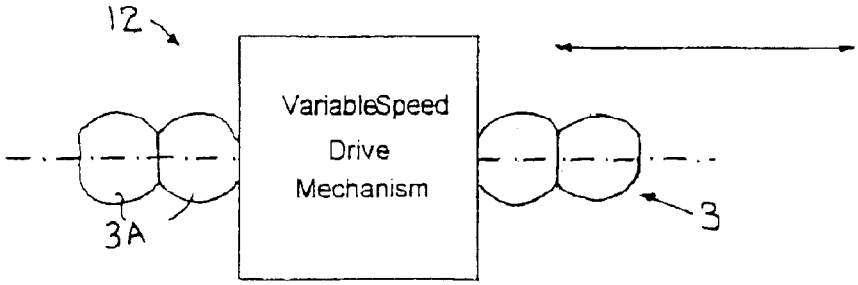
FIG. 6 is a schematic view of a device for selectively feeding into or out of a pool the flexible boom of a pool insulation system according to the invention.

The boom drive means 12 shown in FIG. 6 moves the boom 3 into and out of the pool 1 from its storage position. In particular the boom drive means 12 comprises a variable speed mechanical drive which deploys and retracts the flexible boom 3 in a controlled manner.

Figure 7:
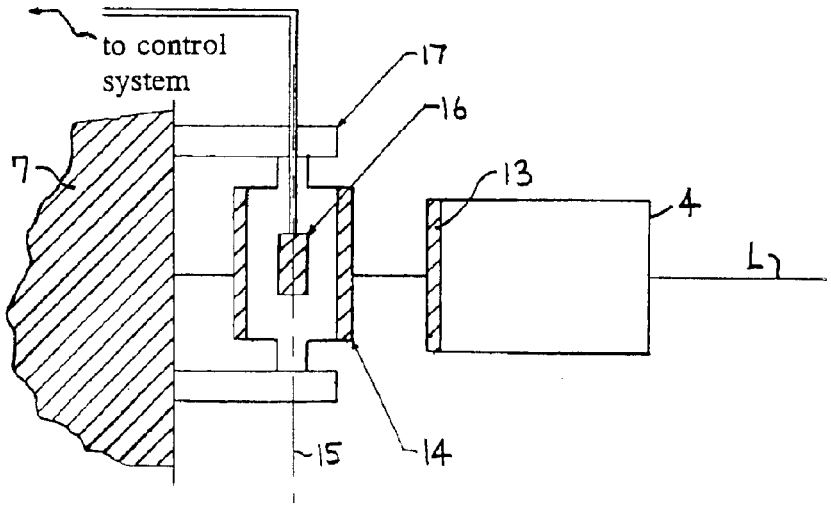
FIG. 7 is a craft mooring device of a pool insulation system according to the invention.

FIG. 7 illustrates one form of docking mechanism for enabling the powered craft 4 to dock automatically in the docked position B (see FIG. 1). The docking mechanism comprises a magnet 13 at the front of the craft 4 and a vertically arranged ferric cylinder 14 supported by support 17 so as to be freely turnable about its vertical axis 15. A sensor 16, typically arranged inside the cylinder 14, forms part of a control system. In use the magnet 13 holds the craft against the ferric cylinder 14 as soon as the craft docks at B. The craft 4 is able to turn with the cylinder 14 about the axis 15 without disengaging from the cylinder until required to do so by the control system.

Figure 9:
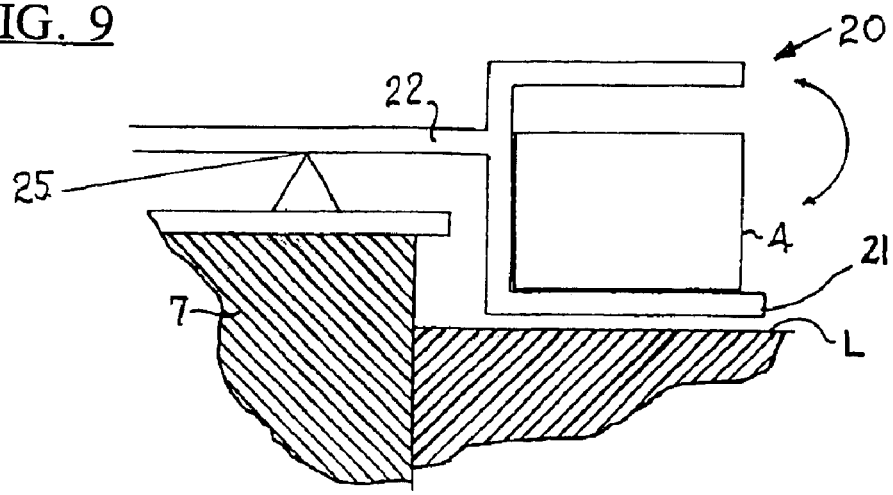
FIGS. 9–11 are schematic side views showing three different positions for a housing device for housing a craft of the pool insulation system according to the invention.
Figure 10:
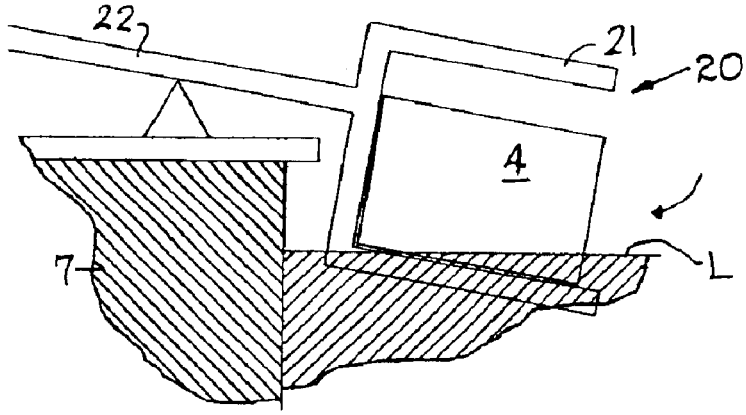
Figure 11:
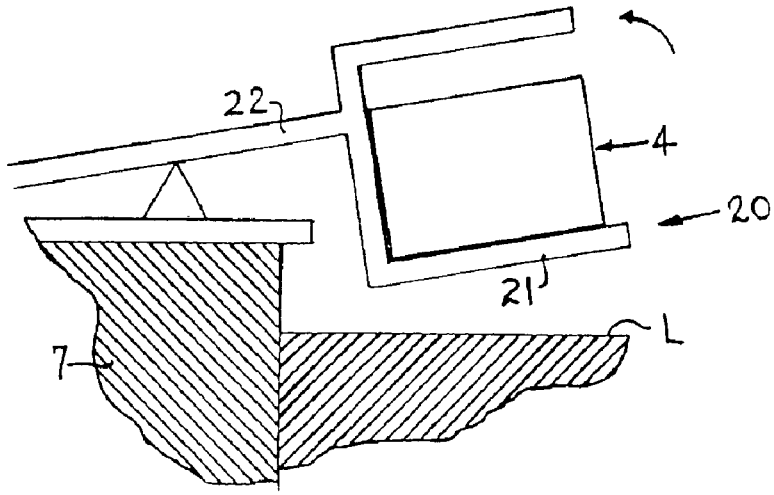

FIGS. 9 to 11 illustrate a storage device 20 for storing the craft 4 when not in use. The storage device comprises a cradle 21 supported at the front end of a pivoted boom 22. The boom can be pivoted about pivot point 25 by an actuating mechanism (not shown) so that the cradle 21 is moved between a raised storage position (FIG. 11), a lowered deployment position (FIG. 10) and an intermediate position (FIG. 9). The rear end of the boom 22 is suitably provided with a weight (not shown) for counterbalancing the weight of the cradle and craft (if housed therein).

Figure 8:
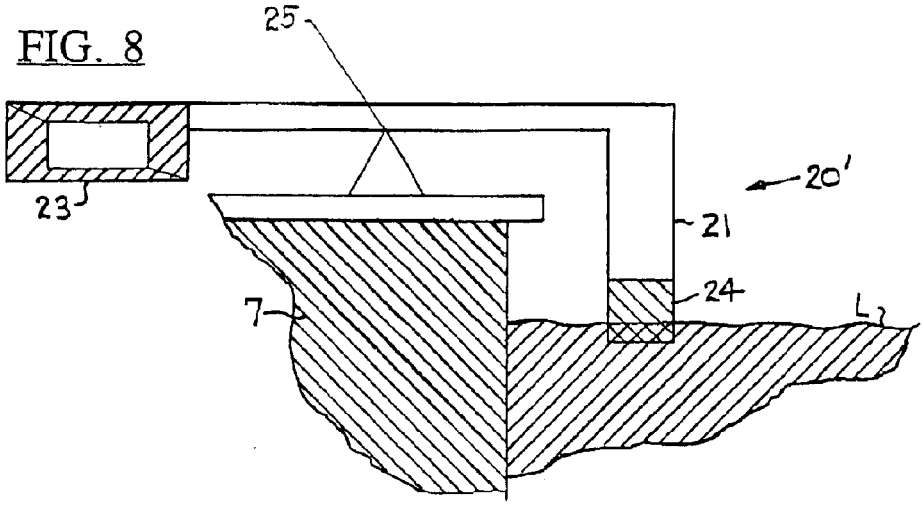
FIG. 8 is a schematic side view of a self-levelling device for removing buoyant articles from the surface of a pool.

A modified form of storage device 20' is shown in FIG. 8. The storage device 20' is provided with a rear counterbalance 23 and a cradle 21 at its front end. Additionally, however, the storage device 20' has a float 24 which enables the device to compensate for varying water levels L of the pool 1.

Figure 14:
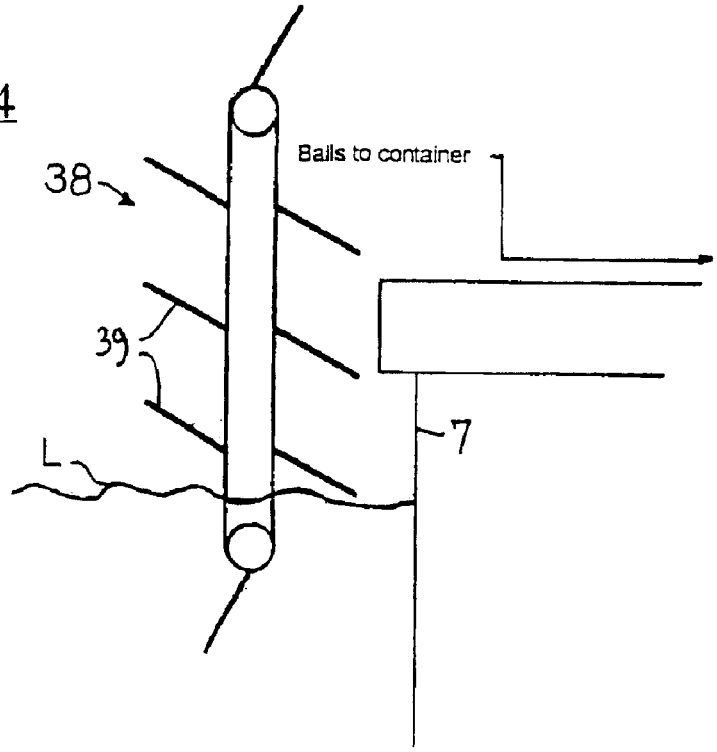
FIGS. 14 and 15 are schematic views of alternative powered removal means for transferring buoyant articles from the surface of the pool to storage means.
Figure 15:
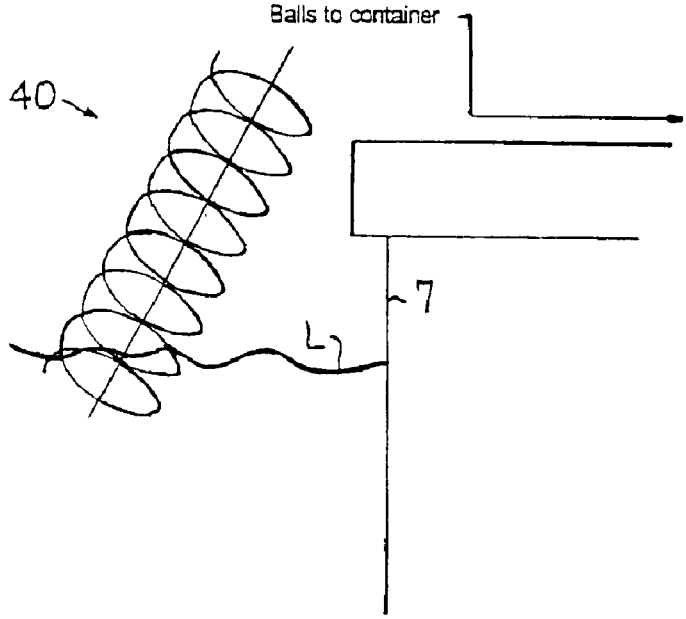

Although it is presently preferred to use suction air suction and/or blow devices to transfer the balls between the pool and the storage means 2, other forms of transfer may be employed. Thus, for example, FIGS. 14 and 15 illustrate schematically an endless conveyor 38 and an Archimedes screw type conveyor 40 each of which conveyors extends upwardly from the surface of the pool. The conveyor 39 has an endless belt on which angled "scoops" 39 are fixed, the movement of the belt causing the scoops to lift the balls from the surface of the pool and raise them for transfer to an elevated storage device. The conveyor 40 is an inclined, rotatable screw for raising the balls from the surface of the pool.

In other embodiments of the invention it is possible for the craft 4 to enter, or be removed from, the pool via a ramp (not shown) or the like. In this case there would be no need for the pivoted storage device 20 or 20'.

Although the storage means 2 described herein have been shown as being above ground, it will be appreciated that the storage means could be positioned partly or fully below ground.

Although the invention is primarily directed to a pool insulation system and a method of removing buoyant articles from a surface of a pool, other aspects of the invention relate to boom deploying apparatus, transfer apparatus for removing buoyant articles from the surface of a pool, craft deploying and housing apparatus and a craft docking system. The transfer systems, although intended for use with a pool insulation system, could be used to clean the surface of a pool by removing floating debris. Similarly the boom deploying apparatus could be used to gather together debris on a pool surface. The craft deploying/housing apparatus could be used to house any craft, preferably an automatically controlled vehicle or craft such as, for example, a pool cleaning vehicle.

What is claimed is:

1. A pool insulation system including storage means for storing a plurality of buoyant articles, first transfer means for transferring said buoyant articles from the storage means to the pool for covering and heat insulating the surface of the pool and second transfer means for transferring the buoyant articles from the pool to the storage means, wherein the second transfer means comprises a buoyant flexible boom comprising a plurality of joined together buoyant members, said flexible boom having a leading end, a motorized craft manoeuvrable around the periphery of the pool with the leading end of the boom attached thereto for enclosing said buoyant articles on the surface of the pool in an enclosure defined by the trailing flexible boom on the surface of the pool and a wall portion of the pool from or adjacent which the articles are to be removed from the pool, and means for changing the length of the flexible boom on the surface of the pool wherein said motorized craft is designed so as to steer to one side in use so that it is able to hug the peripheral walls of the pool.

2. A system according to claim 1, in which said second transfer means includes powered removal means for causing the buoyant articles to be moved upwardly from said enclosure to said storage means.

3. A system according to claim 2, in which the powered removal means includes suction means.

4. A system according to claim 2, in which the powered removal means includes blower means.

5. A system according to claim 1, in which said second transfer means further comprises containing means for containing the flexible boom and said length changing means comprises feed means for selectively feeding the flexible boom into the pool from the containing means or into the containing means from the pool.

6. A system according to claim 1, in which the craft is provided with propulsion means for providing forward thrust.

7. A system according to claim 1, in which the propulsion means are arranged so that the craft veers to one side.

8. A system according to claim 1, in which the leading end of the flexible boom is attached to a rear portion of the craft offset from the longitudinal axis (Y) of the craft.

9. A system according to claim 1, in which the bow of the craft is angled so as to provide a sideways thrust on forward movement of the craft through the water.

10. A system according to claim 1, comprising at least one separate side-thrusting propeller.

11. A system according to claim 10, including wall sensing means for determining when the at least one side-thrusting propeller needs to be operated to move the craft towards the peripheral wall.

12. A system according to claim 1, in which the craft is provided with at least one friction wheel mounted at the front of the craft and positioned to contact, in use, obstructions or walls extending from a wall along which the craft is being propelled, the at least one friction wheel being rotatable about a vertical axis in a direction to cause the front of the craft to move away from the wall along which the craft is being propelled.

13. A system according to claim 1, including attachment means for automatically mooring the craft to the said wall portion after circumnavigation of the pool.

14. A system according to claim 13, in which said attachment means comprises a first attachment member mounted at said wall portion and a second attachment member on said craft, one of said attachment members comprising ferro-magnetic material and the other of said attachment members comprising magnetic means.

15. A system according to claim 14, in which the first attachment member comprises said ferromagnetic material.

16. A system according to claim 14, in which the first attachment member comprises a cylinder mounted for rotation about a vertical axis.

17. A system according to claim 16, in which sensing means is provided to detect when the craft is attached to the first attachment member to cease drive power to the craft.

18. A method of removing buoyant articles from a surface of a pool, comprising providing a flexible boom having a leading end, providing a motorized craft attached to said leading end, maneuvering said motorized craft around the periphery of the pool, positioning said flexible boom on the surface of the pool so as to form an enclosure around the buoyant articles to be removed, the enclosure having a peripheral length being formed by a length of the flexible boom supported on the surface of the water and a wall portion of the pool from or adjacent which the buoyant articles are to be removed, withdrawing the buoyant articles from a portion of said pool at or adjacent the said wall portion, and reducing the peripheral length of said enclosure as the buoyant articles are removed from the pool by reducing the length of the flexible boom supported on the surface of the pool.

19. An automatic boom deployment system for a pool comprising a buoyant flexible boom comprising a plurality of joined together buoyant members, said flexible boom having a leading end, a motorized craft manoeuvrable around the periphery of the pool with the leading end of the boom attached thereto for enclosing said buoyant articles on the surface of the pool in an enclosure defined by the trailing flexible boom on the surface of the pool and a wall portion of the pool, and means for changing the length of the flexible boom on the surface of the pool wherein said motorized craft is designed so as to steer to one side in use so that it is able to hug the peripheral walls of the pool.

20. Pool apparatus operable in a pool having pool walls enclosing the water and extending above the water level, said apparatus comprising, a monitorized craft, and craft housing and deployment means mounted at the edge of the pool adjacent one of the pool walls surround, the craft housing and deployment means comprising a boom pivotable about a horizontal axis and having a craft-receiving cradle at its front end, and means for pivoting the craft housing and deployment means between a cradle lowered position in which the cradle is able to receive the craft from, or to deploy the craft into, the pool, and a craft for storing the motorized craft when the craft is not in use.

21. A pool docking system comprising a pool with a surrounding wall, a monitorized craft, a first attachment member mounted to a portion of said wall, and a second attachment member on said craft, one of said attachment members comprising ferro-magnetic material and the other of said attachment members comprising magnetic means, the first and second attachment members being magnetically coupled together for mooring the craft to said wall wherein said motorized craft is designed so as to steer to one side in use so that it is able to hug the peripheral walls of the pool.

22. A system according to claim 21, in which the first attachment member comprises said ferromagnetic material.

23. A system according to claim 21, in which the first attachment member comprises a cylinder mounted for rotation about a vertical axis.

24. A system according to claim 23, in which sensing means is provided to detect when the craft is attached to the first attachment member to cut drive power to the craft.

* * * * *

UNITED STATES PATENT AND TRADEMARK OFFICE

CERTIFICATE OF CORRECTION

PATENT NO. : 6,874,174 B2
DATED : April 5, 2005
INVENTOR(S) : Timothy Worthington It is certified that error appears in the above-identified patent and that said Letters Patent is hereby corrected as shown below:

Column 8,
Lines 6 and 18, “a monitorized craft” should read -- motorized craft --;
Line 15, “a craft for storing” should read -- a craft raised position for storing --;

Signed and Sealed this

Thirty-first Day of May, 2005

JON W. DUDAS
*Director of the United States Patent and Trademark Office*